US005499910A

United States Patent [19]

Hundt et al.

[11] Patent Number: 5,499,910

[45] Date of Patent: Mar. 19, 1996

[54] INTERNAL GEAR PUMP HAVING A STOP FOR A SICKLE-SHAPED FILLER PART

[75] Inventors: Gerd Hundt; Franz Arbogast; Peter Peiz, all of Heidenheim, Germany

[73] Assignee: J. M. Voith GmbH, Heidenheim, Germany

[21] Appl. No.: 296,318

[22] Filed: Aug. 25, 1994

[30] Foreign Application Priority Data

Aug. 26, 1993 [DE] Germany ..... 43 28 733.6

[51] Int. Cl.[6] ..... F04C 2/10

[52] U.S. Cl. ..... 418/126; 418/131; 418/170

[58] Field of Search ..... 418/126, 131, 418/169, 170

[56] References Cited

U.S. PATENT DOCUMENTS 3,890,066 6/1975 Eckerle ..... 418/126
4,132,514 1/1979 Eckerle ..... 418/126
4,472,123 9/1984 Eckerle et al. ..... 418/126

FOREIGN PATENT DOCUMENTS 2533646 2/1977 Germany .
2606082 8/1977 Germany .

*Primary Examiner*—John J. Vrablik
*Attorney, Agent, or Firm*—Baker & Daniels

[57] ABSTRACT

Internal gear pump with an internal gear, a thrust plate arranged on each side of the internal gear, a powered external pinion arranged eccentrically relative to the internal gear and meshing with it, and a sickle-shaped, floating filler part split in peripheral direction and bearing with its blunt end on an axial support pin. The first segment of the filler part that faces the teeth of the pinion has a greater radial thickness than its second segment facing the teeth of the internal gear. The first segment features in the parting interface at least one axially extending groove for accommodation of a sealing element. The first segment features at least one stop for restricting wear on the surface facing the teeth of the pinion.

12 Claims, 5 Drawing Sheets

INTERNAL GEAR PUMP HAVING A STOP FOR A SICKLE-SHAPED FILLER PART

BACKGROUND OF THE INVENTION

The invention concerns an internal gear pump with an internal gear, a thrust plate arranged on each of the two sides of the internal gear, a powered external pinion of eccentric arrangement relative to the internal gear and meshing with it, and a sickle-shaped floating filler part split in peripheral direction. The sickle-shaped floating filler part bears with its blunt end on an axial support pin while its first segment, facing the teeth of the pinion, has a greater radial thickness than its second segment facing the teeth of the internal gear. The first segment features in the parting surface at least one axially extending groove for accommodating a sealing element.

An internal gear pump of the type described above is known in DE-OS 26 06 082 and DE-OS 25 33 646.

In this prior internal gear pump, the filler part is in peripheral direction split in two segments so that the two segments, due to the pressure prevailing between them, will be forced separately on the tooth heads of the coordinated gears, thereby enabling a compensation for the radial positional shift of pinion and internal gear in contingence on pressure, speed of rotation and viscosity.

The contact force of the tooth heads is so dimensioned that at normal operating conditions there occurs no wear on the filler parts. In practice, however, it has been demonstrated that at extreme operating conditions, for instance with heavily polluted oil or air bubbles contained in it, the conditions of force are altered primarily on the segment facing the pinion, so that this segment endures heavy wear, which eventually leads to breakage of the segment and, thus, total failure of the pump.

Therefore, the problem underlying the invention is to restrict the wear on the first segment facing the pinion, in order to prevent breakage and thus total failure of the pump.

SUMMARY OF THE INVENTION

This problem is inventionally solved by the features of the present invention. The first segment features at least one stop for restriction of wear on the surface facing the teeth of the pinion. Achieved with a stop of this type is that, after an initial wear has occurred on the surface facing the teeth of the pinion, further wear is prevented.

In one embodiment of the invention, the stop is suitably fashioned as a mechanical stop and arranged in the area of the pointed end of the first segment in conjunction with the thrust plates. According to another form of the invention, a second mechanical stop may be provided in the area of the blunt end of the first segment in conjunction with the thrust plates.

Once initial wear has occurred on the first segment, the stop(s) prevent further wear after a certain amount of wear. The occurring thrust forces are then absorbed by the thrust plate bedding on the pinion shaft.

According to a another form of the invention, the stop is fashioned as a pin fitted in an axial bore in the thrust plate and engaging a matching axial bore in the first segment; but this bore has a greater diameter than the pin. It is conceivable as well to fit the stop in kinematic reversal in the first segment and have it engage a bore of greater diameter in the thrust plate. This embodiment of the invention determines the amount of wear that is allowed by the diameter difference between the two bores. The stop is nonfunctional in normal operation.

A further embodiment of the invention provides for fashioning the stop as a hydraulic stop in the form of at least one blind groove provided in the side surfaces of the thrust plates facing the first segment, which groove communicates on its open end with the pressure side of the pump. The arrangement of the blind end of said groove is such that upon completion of restricted wear it will open up toward the pressure side of the pump. Kinematically reversed, it is possible as well to arrange the at least one blind groove on one or both sides of the first segment, wherein the connection with the pressure side may always exist and a connection to the area of pressure buildup then opening up through the wear.

This design of the stop is based on the hydraulic conditions of the pump. The blind grooves machined in the thrust plates or the first segment are in normal operation covered by the axial surface of the first segment or thrust plates and are nonfunctional.

The blind grooves forming the hydraulic stop are exposed only after completed wear on the surface of the first segment facing the pinion heads, due to the resulting shift of the back side of the first segment, and the blind grooves are connected with the pressure side, or pressure space, of the pump.

The use of additional blind grooves allows influencing the pressure buildup control on the first segment in such a way that at the prevailing extreme operating conditions a relief takes place between the tooth heads of the pinion and the first segment and that no further wear will occur.

A further favorable embodiment of the invention provides for establishing between the first segment and the second segment a connection for restricting the gap width in the region of the parting interface, upon completion of restricted wear.

As the first segment wears, the gap between the first and second segments augments. The loose mechanical connection between the two segments ensures that after completed initial wear on the first segment a further gap enlargement will be prevented by the connection.

Lastly, a further embodiment of the invention provides for restraining a rotary motion of the support pin in order to restrict the wear on the surface of the first segment facing the teeth of the pinion. The restraint may be fashioned as stop element on the contact face of the blunt end of the filler part on the support pin, on the back of one of the thrust plates or on the bearing cap. The same effect is obtained by fashioning the restraint as a snug fit of the support pin in the thrust plates or bearing caps.

As practical experience has shown, the wear on the first segment does not take place parallel to the surface facing the tooth heads of the pinion; instead, a torque is created upon the first segment, or filler part, causing the initial wear to occur on the pointed end of the first segment. As the wear continues from the direction of the pointed end of the first segment, the support pin adapts to the new situation and rotates, so that always the entire bearing surface of the blunt end of the filler part bears on the support pin. Restraining the rotation of the support pin as the first segment wears beginning at its point causes the contact of the first segment with the first bearing face of the support pin to change from a planar contact to a linear contact. The force F with which the first segment is pressed on the support pin generates a moment Md about the point of contact which counteracts the wear of the first segment by the tooth heads of the pinion.

BRIEF DESCRIPTION OF THE DRAWINGS

Embodiments of the invention are illustrated in the drawings as more fully described hereafter wherein.

DETAILED DESCRIPTION OF THE INVENTION

Figure 1:
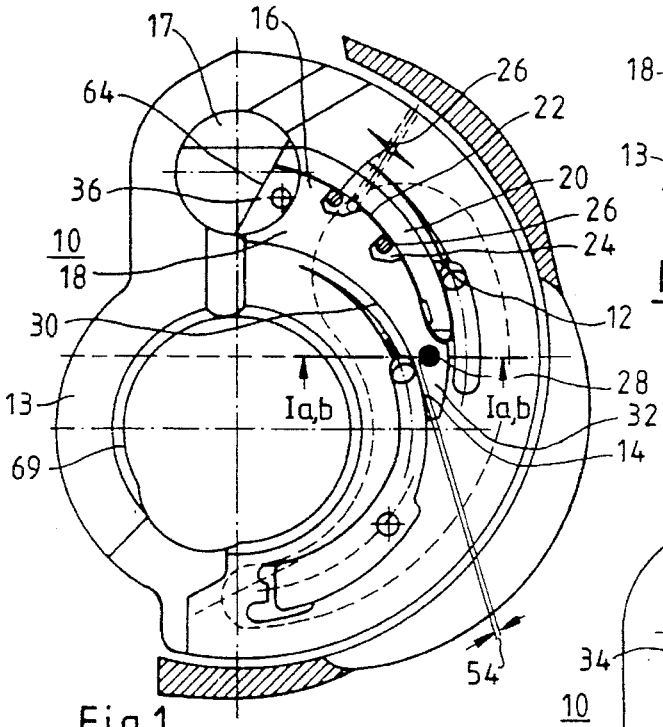
FIG. 1 shows a sectional side elevation of a first embodiment of the internal gear pump.

The internal gear pump 10 illustrated in the figures is generally comprised of an internal gear 12, a thrust plate 13 arranged on each side of the internal gear 12, a powered external pinion 14 arranged eccentrically relative to the internal gear 12 and meshing with it, and a sickle-shaped floating filler part 16 split in peripheral direction and bearing with its blunt end 36 on an axial support pin 17. The filler part 16 features a first segment 18 facing the teeth of the pinion 14 and a second segment 20 facing the teeth of the internal gear 12. The first segment 18 has a greater radial thickness than the second segment 20. Axially extending grooves 24 are provided in the parting interface 22 between the two segments 18, 20, serving to accommodate sealing elements 26.

Figure 1A:
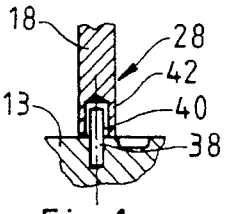
FIG. 1*a* shows a sectional view along line 1*a, b*, 1*a, b* in FIG. 1 illustrating the mechanical stop.
Figure 1B:
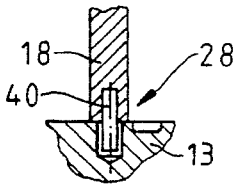
FIG. 1*b* shows a sectional view along line 1*a, b*—1*a*,1*b* of a reversed arrangement of the mechanical stop of FIG. 1*a*.

As shown in FIG. 1, 1*a*, the first segment 18 features on its pointed end 32 a stop 28 for restricting the wear 54 on the surface 30 of the first segment 18 facing the teeth of the pinion 14. As illustrated in FIG. 1*a*, said stop 28 consists of a pin 40 which with its one section is fitted in an axial bore 38 of a thrust plate 13. With its other section, the pin 40 is arranged in an axial bore 42 in the first segment 18, said bore 42 having a diameter larger than the axial bore 38 in the thrust plate 13. As shown in FIG. 1*b*, a kinematically reversed arrangement is conceivable as well, i.e., the snug fit is in this case in the first segment 18 while the bore with the greater diameter is arranged in the thrust plate 13. Once the initial wear has taken place, the thrust forces created between the first segment 18 and pinion 14 are absorbed by the thrust plate bedding 69 on the pinion shaft.

Figure 2:
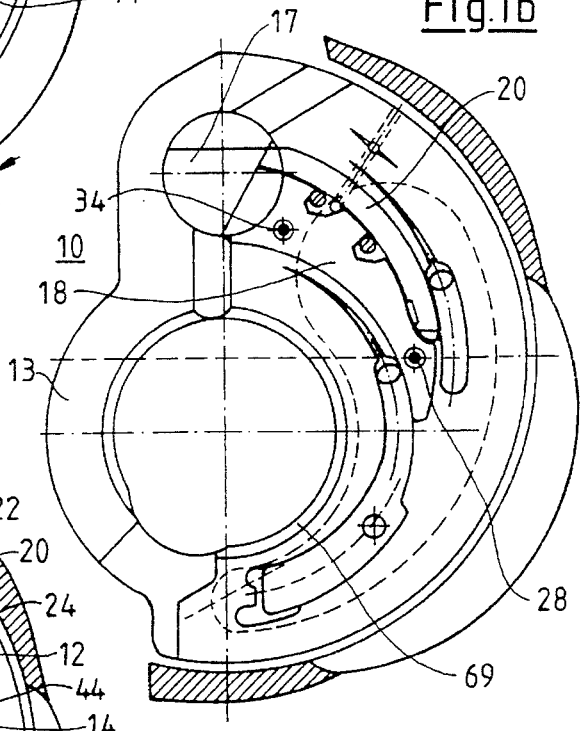
FIG. 2 shows a sectional side elevation of a second embodiment of an internal gear pump with mechanical stop.

A further embodiment of the invention is illustrated in FIG. 2. A second mechanical stop 34 is provided in this embodiment in the area of the blunt end 36 of the first segment 18 of filler part 16. Said second stop 34 conforms with the first stop 28.

Figure 3:
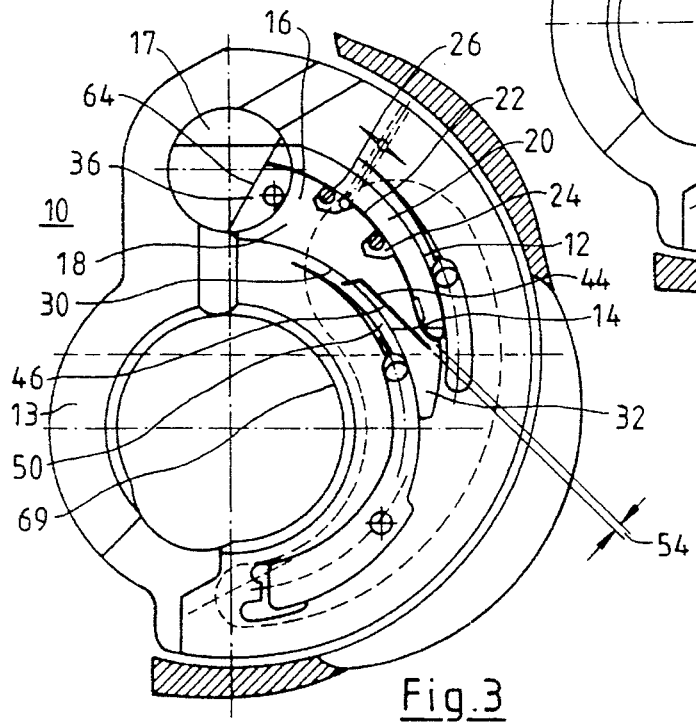
FIG. 3 shows a sectional side elevation of a third embodiment of the internal gear pump with hydraulic stop.
Figure 4:
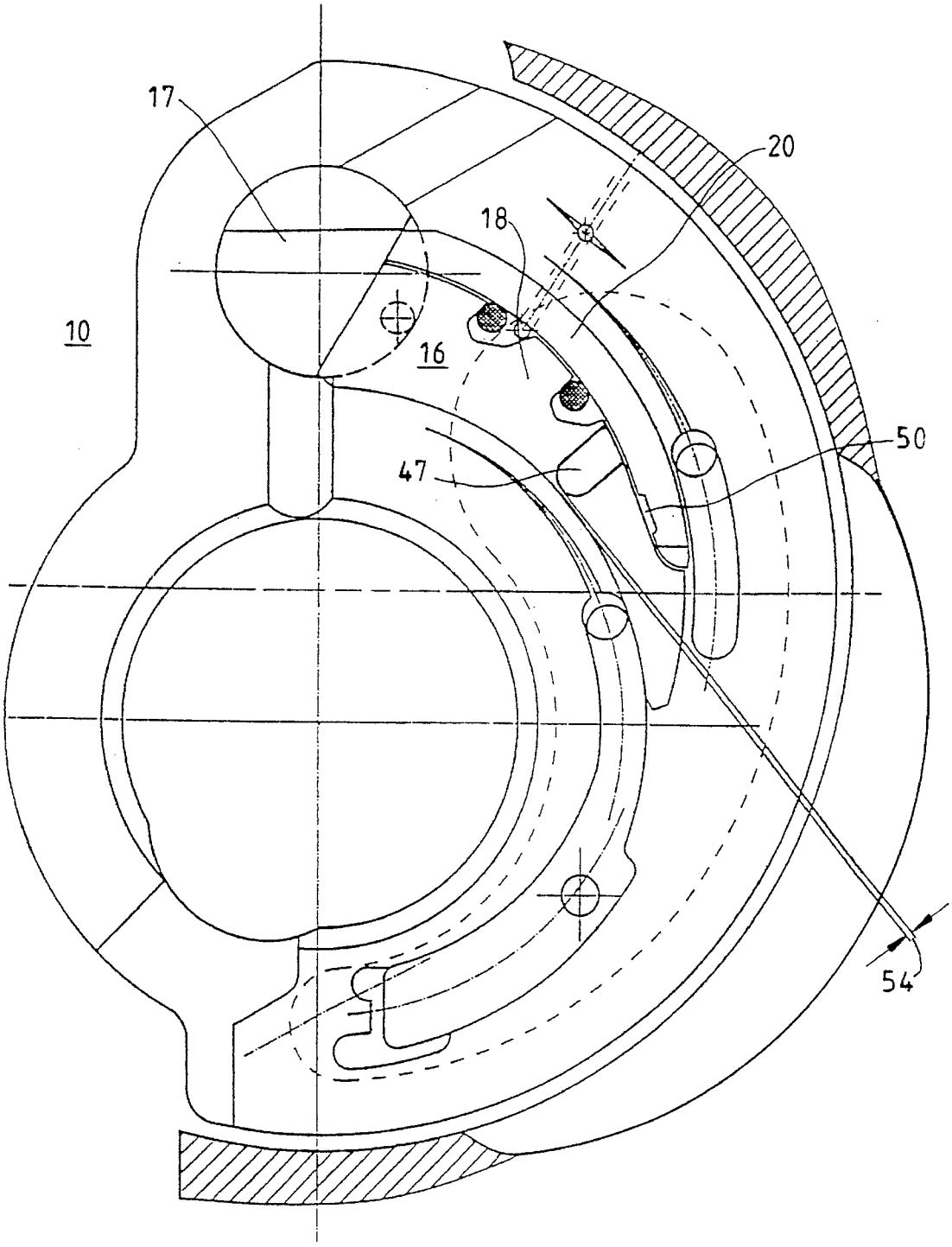
FIG. 4 shows a sectional side elevation of a fourth embodiment of the internal gear pump with hydraulic stop.

In the embodiment of the internal gear pump 10 illustrated in FIG. 3, the stop is fashioned as a hydraulic stop 44. This hydraulic stop 44 consists of at least one blind groove 46 provided in the side surfaces of the thrust plates facing the first segment. The open end of the blind groove 46 communicates with the pressure side 50 of the internal gear pump 10. The blind end is in normal operation covered by the side surface of the first segment 18. The blind groove 46 forming the hydraulic stop 44 is exposed on its blind end only upon completion of the wear 54 on the surface 30 of the first segment 18 facing the teeth of the pinion 14, by the resulting shift of the parting surface 22, and connected with the pressure side 50 of the internal gear pump. The pressure buildup on the first segment 18 is thereby influenced in a fashion such that at extreme conditions a relief takes place between the teeth of the pinion 14 and the first segment 18, so that no further wear will take place. Depending on requirements, several blind grooves 46, or control grooves, may be provided as well in the thrust plates 13. It is also possible to arrange the blind grooves in kinematic reversal in the side surfaces on the first segment 18, on one or both sides (refer to blind groove 47 in FIG. 4); the blind groove now communicates with the pressure side 50 and, upon completed wear 54, a connection opens up to the pressure side.

The closed end of the blind groove is suitably fashioned as a radius, because the size of the connection (of the conduit) automatically adjusts then to the prevailing hydraulic conditions. Hence, the wear on the inside of the filler part continues until a sufficient cross section is available to establish hydraulic equilibrium.

Figure 5:
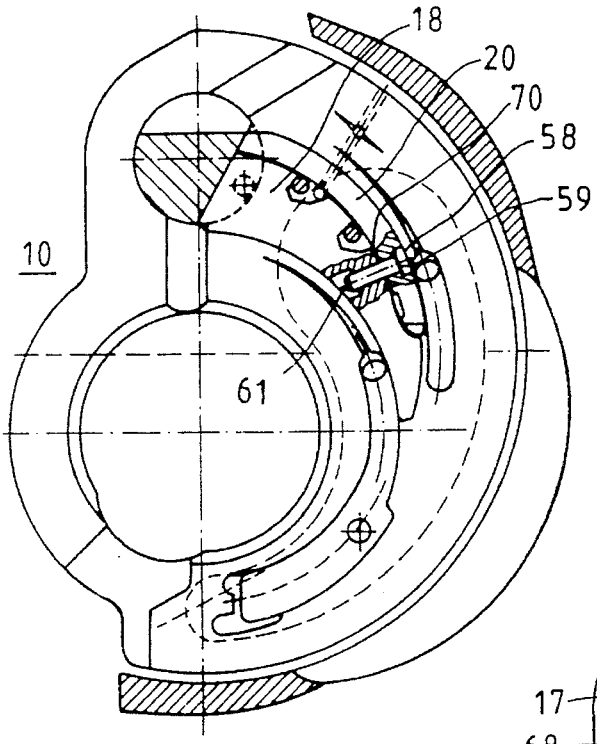
FIG. 5 shows a sectional side elevation of a fifth embodiment of the internal gear pump with a connection between the first and second segments.
Figure 6:
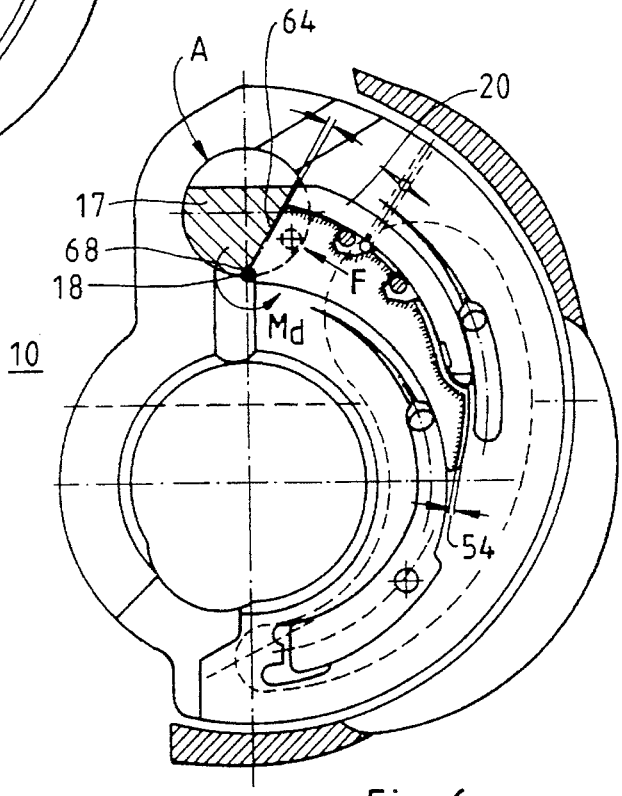
FIG. 6 shows a sectional side elevation of a sixth embodiment of the internal gear pump with a restricted rotary motion of the support pin.
Figure 8:
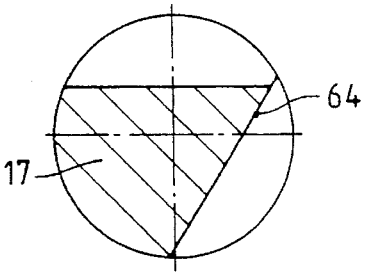
FIG. 8 shows a detail view of detail "A" in FIG. 6 illustrating the snug fit in the thrust plates.
Figure 9:
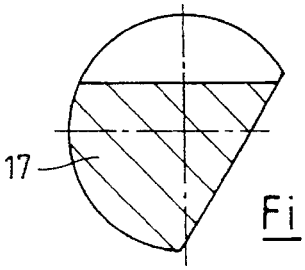
FIG. 9 shows a detail view showing detail "A" in FIG. 6 for illustration of the snug fit in the bearing cap.
Figure 5A:
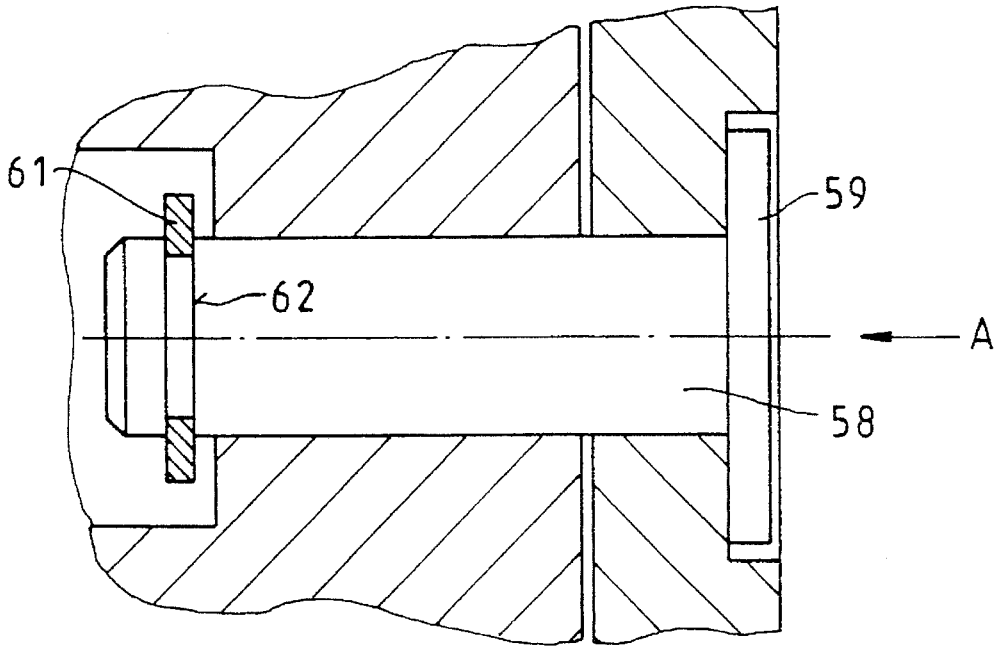
FIG. 5A shows an enlarged view, partially in section, of the connection, collar and retainer shown in FIG. 5.
Figure 5B:
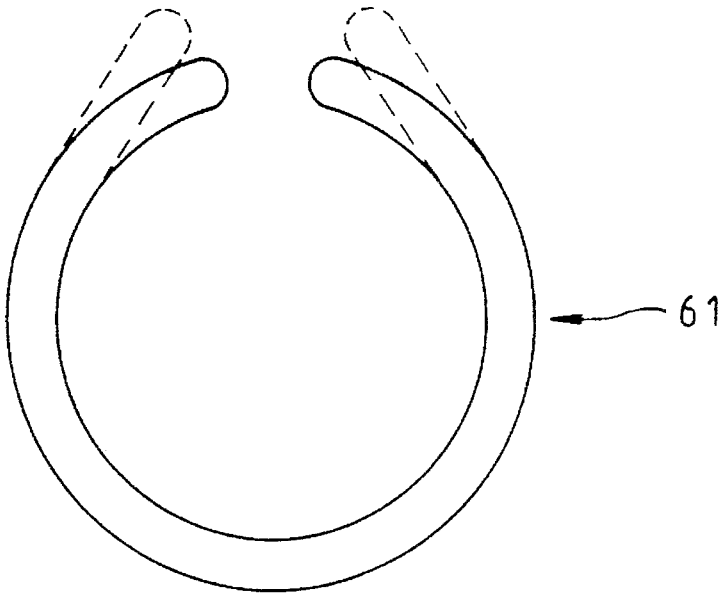
FIG. 5B shows an enlarged view of the retainer of FIG. 5.

A further embodiment of the invention is illustrated in FIG. 5. To restrict the width of the gap 70 in the area of the parting surface 22, a connection 58 is provided in this embodiment between the first segment 18 and second segment 20. Connection 58 is a pin inserted through bores in segments 18, 20 and includes a collar 59 at one end and an retainer 61, such as a clamping spring, at its other end. This is best shown in FIG. 5A. Clamping spring 61 resides in annular grove 62 in connection pin 58. Clamping spring 61 is further illustrated in FIG. 5B. The dashed line indicates how clamping spring 61 may be widened so that it may be pushed over the left hand end (as shown in FIG. 5A) of pin 58, until it snaps into annular groove 62 due to the resilient force of the clamping spring. Such clamping springs are known in the art, and are widely used with mechanical devices. As occurs on the first segment 18, first segment 18 and the second segment 20 continues to enlarge. A further enlargement of the gap, and thus further wear on the first segment 18, is prevented by providing a loose mechanical connection between the two segments 18, 20.

Other embodiments of the internal gear pump are shown in FIG. 6 through 9. It has been demonstrated that the first segment 18 does not wear parallel to the surface facing the tooth heads of the pinion 14; instead, due to a torque acting on the first segment 18, increased wear occurs on the pointed end 32 of the first segment 18. As the wear continues from the pointed end 32 of the first segment 18, the support pin 17 adapts to the new situation and rotates, so that always the entire bearing surface 64 of the blunt end 36 of the filler part 16 bears on the support pin 17. To restrict the wear on the first segment 18, a restraint for the rotary motion of the support pin 17 is provided in this embodiment of the internal gear pump 10. As the first segment 18 wears commencing on the pointed end 32, the contact of the first segment 18 on the bearing surface 64 of the support pin 17 changes thereby from a planar contact to a line contact in the contact point 68. The force F with which the first segment 18 is pressed on the support 17 generates around the point 68 a moment Md which counteracts the wear of the segment 18 by the teeth of the pinion 14.

Figure 7:
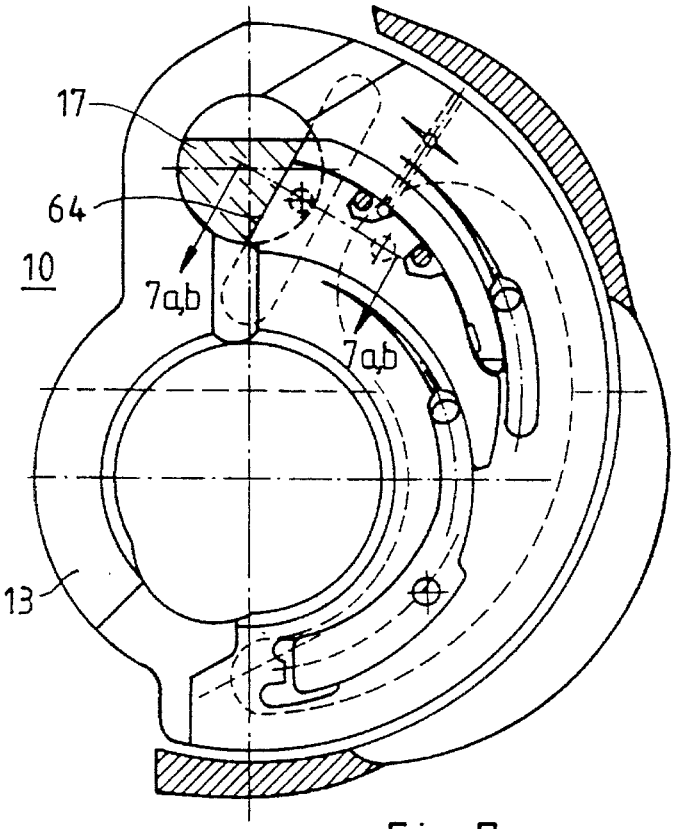
FIG. 7 shows a sectional side elevation of a seventh embodiment of the internal gear pump with restricted rotary motion of the support pin.
Figure 7B:
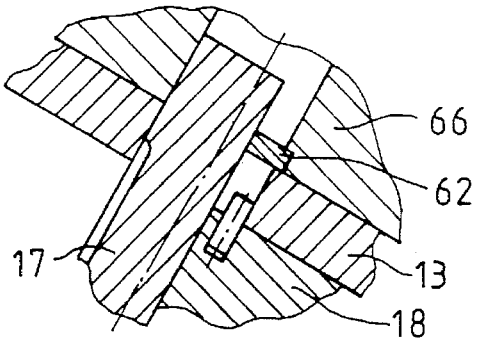
FIG. 7*a, b*, show sectional views along line 7*a, b*—7*a, b* in FIG. 7 illustrating two alternative embodiments of the restraint.
Figure 7A:
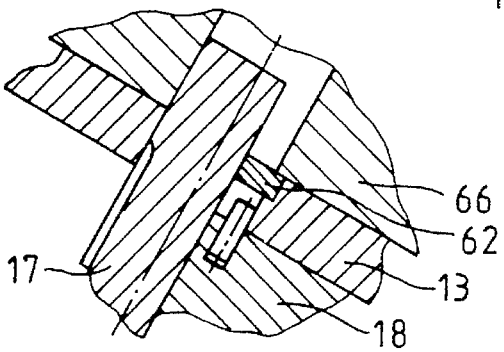

In the embodiment illustrated in FIG. 7, the restraint is fashioned as a stop element 62; it may be provided either in the back of the thrust plates 13 (refer to FIG. 7*a*) or in the bearing caps 66 (refer to FIG. 7*b*). Another option of fashioning the restraint is a snug fit with which the support pin 17 is fitted either in the thrust plates 13 or in the bearing caps 66 (refer to FIGS. 8 and 9).

In the described internal gear pump, said wear 54 is restricted by providing a stop in one of the embodiments described above or in their combination, after a certain wear has occurred on the surface 30 of the first element 18 facing the tooth heads of the pinion 14. Hence, no further wear occurs on the first segment 18, thus preventing a destruction of the internal gear pump.

What is claimed is:

1. An internal gear pump comprising:

an internal gear, said internal gear having two sides;

a thrust plate arranged on each side of the internal gear, said thrust plates having side surfaces;

a powered external pinion arranged eccentrically relative to the internal gear and meshable with said internal gear;

a sickle-shaped, floating filler part, said floating filler part split in peripheral direction and having a blunt end, said blunt end bearing on an axial support pin, said floating filler part having a first segment and a second segment, said first segment having a surface facing the teeth of the pinion, said second segment having a surface facing the teeth of the internal gear, said first and second segments having a parting interface therebetween, said first segment having a greater radial thickness than said second segment, said first segment including at least one axially extending groove arranged at said parting interface for accommodation of a sealing element, said first segment including at least one stop for restricting wear on the surface of said first segment facing the teeth of the pinion.

2. The internal gear pump of claim 1, wherein the first segment has a pointed end, and wherein said stop comprises a mechanical stop situated in closely spaced relationship with said pointed end.

3. The internal gear pump of claim 2, further comprising a second mechanical stop situated in closely spaced relationship with the blunt end of the first segment of the filler part and carried by the thrust plates.

4. The internal gear pump of claim 1, wherein said stop comprises a pin fitted in an axial bore in a thrust plate, said pin being engageable with a corresponding axial bore in the first segment, said first segment axial bore being of greater diameter than the diameter of the pin.

5. The internal gear pump of claim 1, wherein the stop comprises a pin fitted in an axial bore in the first segment, said pin being engageable with a corresponding axial bore in the thrust plate, said thrust plate axial bore being of greater diameter than the diameter of the pin.

6. The internal gear pump of claim 1, wherein a side surface of a thrust plate faces the first segment and wherein the pump has a pressure side, said stop comprising a hydraulic stop having at least one blind groove facing the first segment and situated in the facing side surface of the thrust plate, said blind groove having an open end and a blind end, said blind groove communicating at said open end with the pressure side of the pump, the blind end being situated such that it opens toward the pressure side of the pump upon the occurrence of restricted wear.

7. The internal gear pump of claim 1, wherein the pump has a pressure side, and wherein the stop comprises a hydraulic stop having at least one blind groove situated in a side surface of the first segment, which blind groove has an open end and a blind end, said open end communicating with the pressure side of the pump, said blind end being situated such that it opens to the pressure side of the pump upon the occurrence of restricted wear.

8. The internal gear pump of claim 1, wherein relative movement of said first and second segments at said parting interface forms a gap width, said pump further comprising a connection for restricting the gap width after restricted wear has occurred, said connection being situated between the first segment and the second segment.

9. The internal gear pump of claim 1, wherein the axial support pin has a rotary motion, said pump further comprising a restraint for the rotary motion of the support pin to restrict the wear of the surface of the first segment facing the teeth of the pinion.

10. The internal gear pump of claim 9, wherein said restraint comprises a stop element on the bearing surface of said blunt end, on the axial support pin, or in a bearing cap.

11. The internal gear pump of claim 9, wherein said restraint comprises a snugly-fitting connection between said support pin in a thrust plate, or in a bearing cap.

12. Internal gear pump with an internal gear having two sides, a thrust plate arranged on each of the two sides of the internal gear, a powered external pinion arranged eccentrically relative to the internal gear and meshing with the gear, and a sickle-shaped, floating filler part split in peripheral direction and bearing with a blunt end on an axial support pin, a first segment of said filler part facing the teeth of the pinion and having a greater radial thickness that a second segment of the filler part facing the teeth of the internal gear, with the first segment featuring in a parting interface at least one axially extending groove for accommodation of a sealing element, wherein the improvement comprises at least one stop means in said first segment for restricting wear on a surface of the first segment facing the teeth of the pinion after a selected initial wear has occurred.

* * * * *